US006152243A

United States Patent [19]

Junkers

[11] Patent Number: 6,152,243

[45] Date of Patent: Nov. 28, 2000

[54] UNIVERSAL TORQUE POWER TOOL

[76] Inventor: John K. Junkers, 7 Arrowhead La., Saddle River, N.J. 07540

[21] Appl. No.: 09/369,007

[22] Filed: Aug. 5, 1999

[51] Int. Cl.[7] ..... B25B 21/00

[52] U.S. Cl. ..... 173/176; 173/171; 173/181; 173/216

[58] Field of Search ..... 173/176, 180, 173/181, 182, 183, 216, 217, 179, 171

[56] References Cited

U.S. PATENT DOCUMENTS

| | | | |
|---|---|---|---|
| 5,285,857 | 2/1994 | Shimada | 173/182 |
| 5,315,501 | 5/1994 | Whitehouse | 173/176 |
| 5,617,924 | 4/1997 | Baron et al. | 173/181 |
| 5,730,232 | 3/1998 | Mixer | 173/216 |
| 5,893,420 | 4/1999 | Schoeps | 173/181 |
| 5,984,020 | 11/1999 | Meyer et al. | 173/176 |

*Primary Examiner*—Scott A. Smith
*Attorney, Agent, or Firm*—Michael J. Striker

[57] ABSTRACT

A universal torque power tool has a housing having a motor, a driving mechanism being operatively connected with the motor, the driving mechanism including a drive having an axis and being engageable with a nut to be turned, first and second transfer members to apply a reaction force substantially coaxial with the axis of the drive and spaced from one another in direction of the axis, the drive being formed to transfer an action force from the motor to a nut to be turned, the transfer members being formed to engage a stationary object and to transfer a reaction force to the stationary object, so that when the stationary object is engageable outside of the nut engagement the first transfer member transfer the reaction force to the stationary object, and when the stationary object is engageable inside the nut engagement the second transfer member transfer the reaction force to the stationary object.

8 Claims, 5 Drawing Sheets

1
2
3
4
5
6
7
7
8
9
10
11
12
13
14
15
16
17
31
32
33
90
A

UNIVERSAL TORQUE POWER TOOL

BACKGROUND OF THE INVENTION

The present invention relates generally to torque power tools.

Power tools are known in the art. Every torque power tool has an action force and an equal and opposite reaction force. Both forces tend to turn around a turning axis. In a hydraulic torque tool, a torque multiplier, an electric multiplier or an air wrench, the action equals the reaction in opposite direction. As tightening fasteners are becoming a more precise art, accurate or at least even bolt loads is a requirement. However, this can not be accomplished with slugging wrenches or impact wrenches.

There are two methods of tightening a bolt. One method is torquing and the other method is tensioning. However, it was not possible to convert a tool from a hydraulic torque tool to a hydraulic tensioner. In the past, customers had to buy a separate tool to tension corresponding fasteners.

While torquing is the way of turning a nut down on the bolt to elongate it, it has a disadvantage that it applies torsion to the bolt or has the bolt turned along with the nut, which in turn requires a use of back-up wrench applied to the nut on the other side of the application. Torque can be applied to any existing bolt and nut. Tensioning, on the other hand, requires the bolt to stick out by at least its diameter over and about the nut, so that it can be pulled upwards by a tensioner. Bolt replacements and most of the time nut replacements are necessary to apply tensioners. As it is the trend in industry to get away from cumbersome and complicated hydraulic tensioners, yet also from torquing due to the torsion and side-load applied to the bolt, mechanical tensioning is becoming very popular.

SUMMARY OF THE INVENTION

Accordingly, it is an object of present invention to provide a universal torque power tool which avoids the disadvantages of the prior art.

In keeping with these objects and with others which will become apparent hereinafter, one feature of present invention resides, briefly stated, in a tool having motor means, a driving mechanism being operatively connected with the motor means, the driving mechanism including drive means having an axis and engageable with a nut to be turned, first and second transfer means to apply a reaction force substantially coaxial with the axis of the drive means and being spaced from one another in direction of the axis, the drive means being formed to transfer an action force from the motor means to a nut to be turned, the transfer means being formed to transfer a reaction force to the stationary object, so that when the stationary object is engaged outside the nut engagement with said drive means the first transfer means transfer the reaction force to the stationary object, and when the stationary object is engaged inside the nut engagement with said drive means the second transfer means transfer the reaction force to the stationary object.

When the tool is designed in accordance with the present invention, the same tool can be used both for torquing and for tensioning, and it is not necessary to have two separate tools. The new tool corresponds to all industrial requirements and it can be used in corresponding different ways. At the same time, it permits the tool to be used on standard bolts and nuts where it reacts against the stationary object adjacent to the nut to be turned and acts on the nut, on our clamp nut U.S. Pat. No. 5,318,397, U.S. Pat. No. 5,539,970 including inner and outer sleeves and a washer so as to react on the washer and to act on the outer sleeve, or to react on the inner sleeve and act on the outer sleeve, on a bolt end that is to remain stationary and simultaneously on a stationary object adjacent to the nut to be turned by the active force, on a stationary bolt on which it reacts while acting on the nut, or on any other application where the stationary object (s) is (are) engageable inside the nut to be turned, or outside the nut to be tuned or inside and outside the nut to be turned by driving means.

This is achieved by providing the above mentioned two transfer means which correspondingly transfer the reaction force applied by the tool housing to a corresponding stationary object/objects. The tool therefore can operate so that it reacts on an adjacent stationary object, or on the inner sleeve, and/or on the washer of the clamp nut, or on a stationary bolt, or on a bolt and on a washer simultaneously. When it reacts on the adjacent stationary object or on the stationary bolt, the nut is being torqued. When it reacts on the inner sleeve, or the washer of the clamp nut, the bolt is being tensioned or pulled straight up.

As there is a trend industry to use mechanical tensioning nuts while simultaneously applying the same tool for regular nuts, the tool in accordance with the present invention permits the various tasks and can be used on all existing fasteners, rather than having to change tools when going from torquing to tensioning as is common now.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
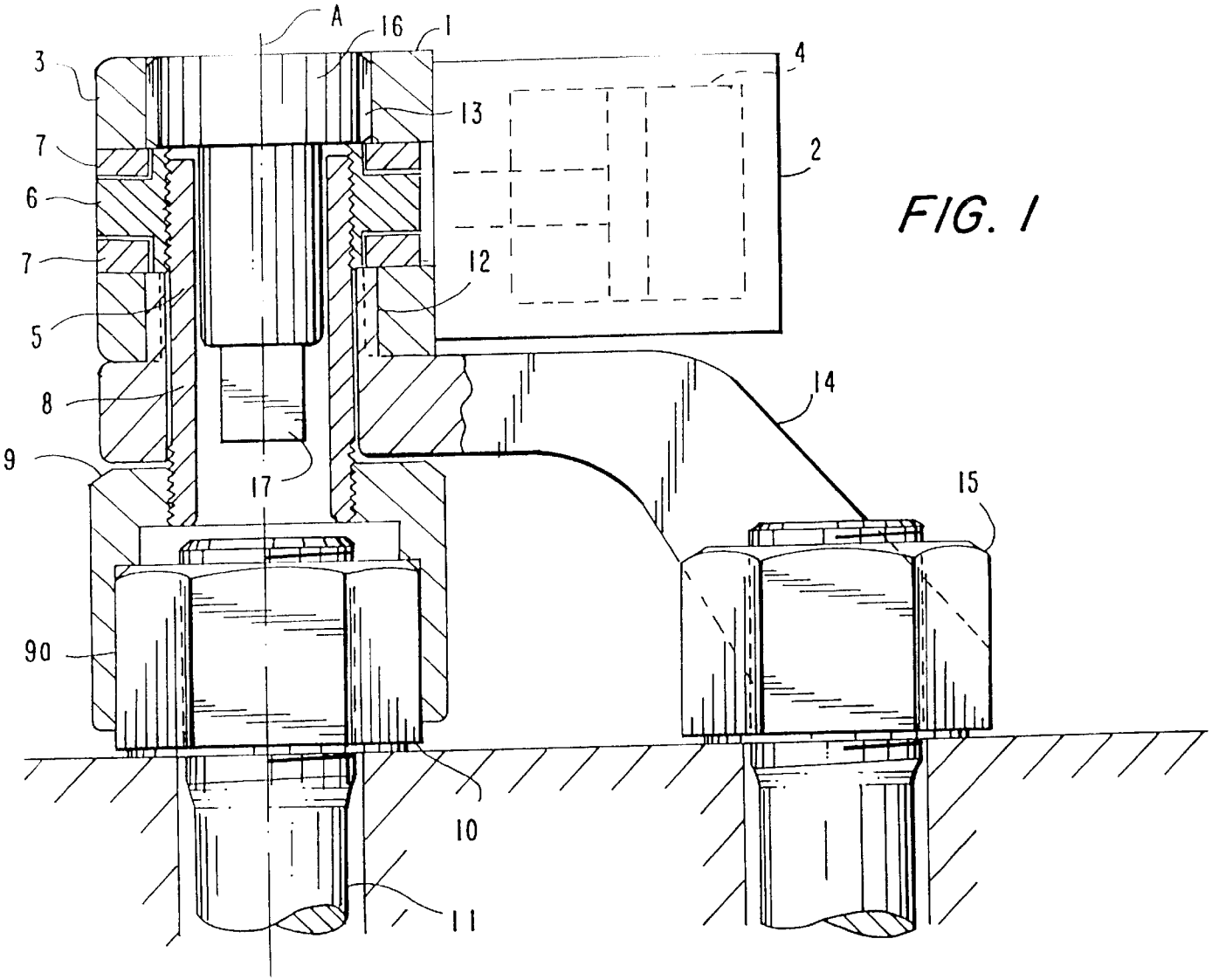
FIG. 1 is a view showing a universal torque power tool in accordance with the present invention which applies an action force to the nut and a reaction force to a stationary object engageable outside said nut, engagement.

A universal torque power tool in accordance with the present invention has a housing which is identified as a whole with reference numeral 1 and includes a first housing portion 2 and a second housing portion 3. The first housing portion 2 accommodates motor means 4 which can be formed for example as conventional fluid-operated cylinder-piston means, with a cylinder provided in the second housing portion 2, a piston reciprocatingly movable in a chamber of the cylinder, and a piston rod connected with the piston and reciprocating with the same.

The second housing portion 3 accommodates a driving mechanism with drive means 5 formed for example as a ratchet 6 which is arranged between drive plates 7 and has an axis A. The drive plates are turnable by the piston rod and the motor means 4 and carry not shown pawl means which, during reciprocation of the piston rod with the piston, turns the ratchet 6 around the axis A in the same direction during an advance stroke of the piston and a return stroke of the piston of the motor means 4.

The ratchet 6 forms a driving element of the drive means. A drive sleeve 8 is non-rotatably connected with the ratchet 6 for joint rotation therewith, for example by interengaging splines. An engaging element which is formed to engage a fastener to be turned is non-rotatably connected with the drive sleeve 8 at its opposite axial end for joint rotation therewith, for example by enterengaging splines. The engaging element 9 shown in FIG. 1 is formed as a socket which is provided with an inner hexagonal opening and is engageable with a hexagonal formation 9*a* of a nut 10 screwed on a stud 11.

The inventive universal torque power tool further has transfer means which include a first transfer means 12 and a second transfer means 13. The transfer means 12 and 13 are spaced from one another in an axial direction of the axis A. The transfer means 12 and 13 are formed to engage a corresponding stationary object and transfer a reaction force from the housing 1 to the corresponding stationary object. The universal torque power tool further has connection means for connecting the transfer means 12 and 13 to the corresponding stationary objects. The first connection means for the first transfer means in FIG. 1 is formed as a reaction arm 14. The first transfer means are formed for example by splines provided on the housing portion 3 and on one end of the reaction arm 14, while the opposite end of the reaction arm is formed to cooperate with a fixed object located outside the nut 10 at a lateral side of the tool. A fixed object 15 in FIG. 1 is formed as a neighboring nut screwed on the neighboring bolt. The second connecting means for the second transfer means is formed for example as a stepped shaft 16. The second transfer means 13 are formed for example as splines provided on the housing portion 3 and one end of the stepped shaft 1 and interengaging with one another, while the opposite end of the stepped shaft 16 has for example a polygonal projection 17.

During the operation, the motor means 4 turn the ratchet 6 of the drive means 5 so to apply an action force through the drive sleeve 8 and the socket 9 to the nut 10, while the first transfer means 12 apply an opposite reaction force through the reaction arm 14 abutting against the nut 15, and the nut 10 is being torqued.

In the embodiment shown in FIG. 1, the action force is applied to the nut 10, the first transfer means 12 apply the reaction force to the stationary object 15 located outside the engagement of the drive means with nut 10, while the second transfer means 13 do not apply any reaction force.

Figure 2:
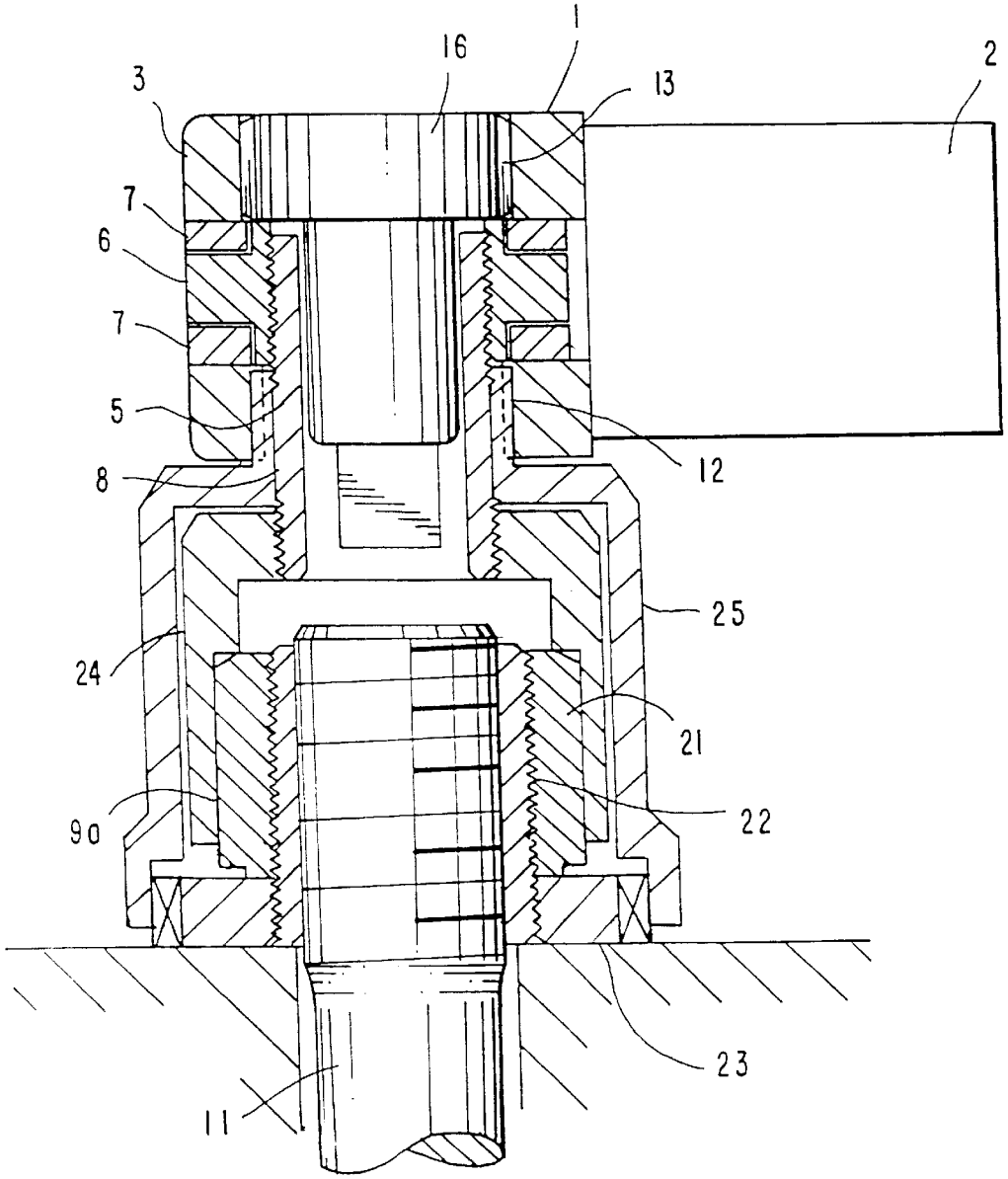
FIG. 2 is a view showing universal torque power tool in accordance with the present invention which applies an action force to a nut and a reaction force to another stationary object engageable outside said nut engagement.

In the embodiment of FIG. 2, the part which corresponds to the parts of the first embodiment are identified as the same with reference numerals. The universal torque power tool shown in the embodiment of FIG. 2 is used for acting on a clamp nut which includes an outer sleeve 21 having for example an outer hexagonal surface, an inner sleeve 22 which is connected with the outer sleeve 21 for example by a thread and has an inner thread screwed on the outer thread of the stud 11, and a washer 23 on which the outer sleeve 21 freely turns and which has inner splines cooperating with outer splines of the inner sleeve 22. The lower end of the drive sleeve 8 is connected for example by splines with a hexagonal socket 24 which has an inner hexagonal opening for engaging the outer hexagonal surface 9*a* of the outer sleeve 21. The first connecting means is formed as a reaction sleeve 25 having a lower end which is provided with a hexagonal opening interengaging with the hexagonal surface of the washer 23. The first transfer means 12 transfers a reaction force from the housing to the reaction sleeve 25 and then to the washer 23 engageable outside the nut engagement 9*a*. The second transfer means 13 does not transfer any reaction force.

During the operation of the tool shown in FIG. 2, the action force transmitted from the motor means 4 to the ratchet 6 is applied through the drive sleeve 8 and the socket 24 to the outer sleeve 21 so as turn the latter, while simultaneously the reaction force is applied by the housing through the reaction socket 25 to the washer 23 engageable outside the nut engagement 9*a*. As a result, the bolt is being tensioned or pulled straight up.

Figure 3:
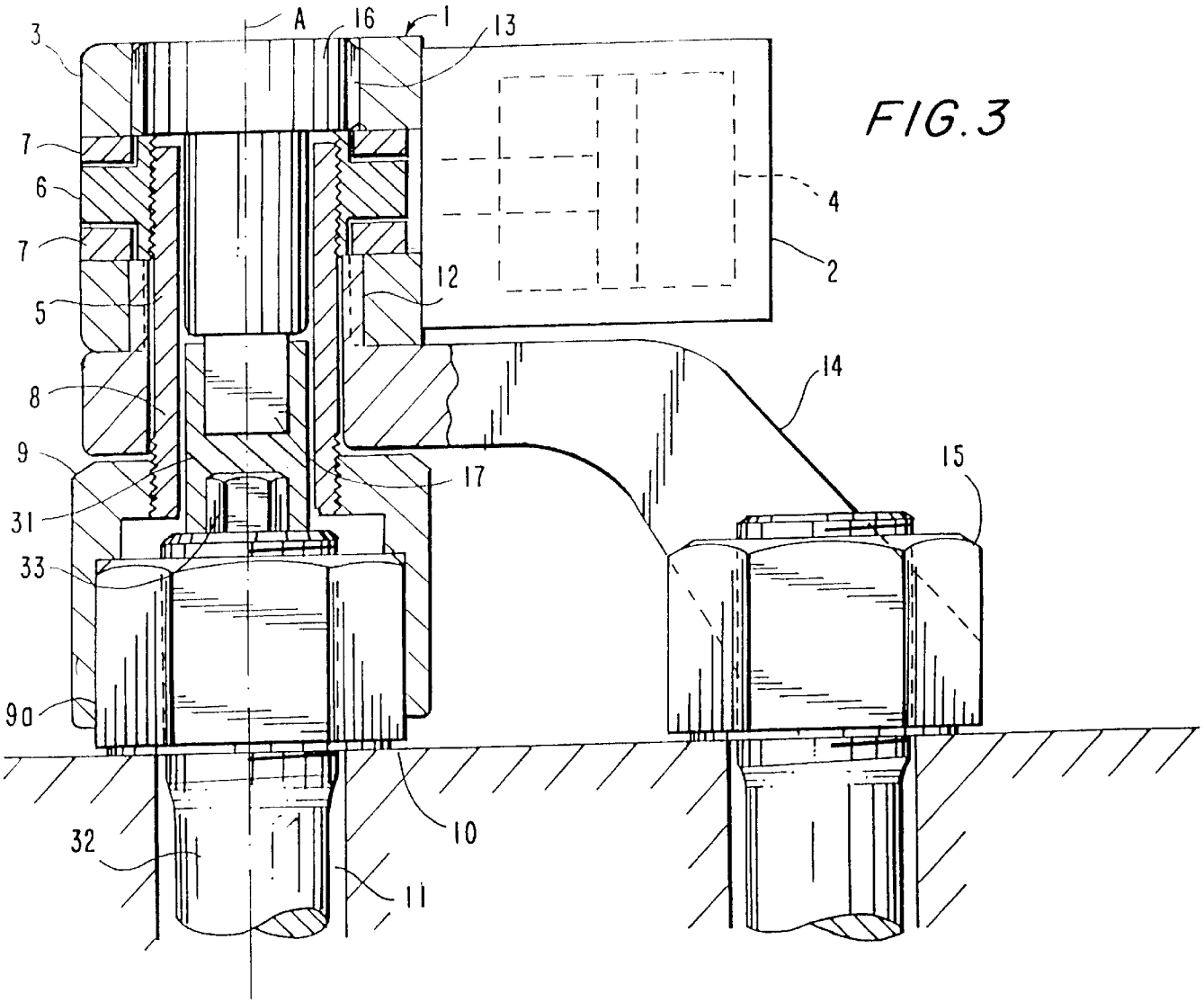
FIG. 3 is a view showing a universal torque power tool which applies an action force to a nut and a reaction force applied to a stationary object engageable inside the nut and to a stationary object engageable outside said nut engagement.

In the universal torque power tool shown in FIG. 3, a reaction socket 31 has a first, upper end with a polygonal opening in which the polygonal projection 17 of the stepped shaft 16 engages, and a lower end which has a polygonal inner opening. A bolt 32 has an upper polygonal head 33 which engages in the polygonal opening of the reaction socket 31. The socket 9 and nut engagement 9*a* of this embodiment substantially corresponds to the socket 9 and nut engagement 9*a* embodiment of FIG. 1.

During the operation of the universal torque power tool of FIG. 3, the action force applied by the motor means 4 to the ratchet 6 is transmitted through the drive sleeve 8 and the socket 9 via the nut engagement 9*a* to the nut 10, while a first reaction force is applied through the first transfer means 12 and the arm 14 to the nut 15, and a second reaction force is applied through the second transfer means 13, the stepped shaft 16, and the socket 31 to the bolt head 33. Thus, the reaction force is applied to one stationary object engageable outside the nut engagement 9*a* and to another stationary object engageable inside the nut engagement 9*a*, by the first transfer means 12 and the second transfer means 13 correspondingly. The bolt 33 is being torqued but pulled straight up without torsion.

Figure 4:
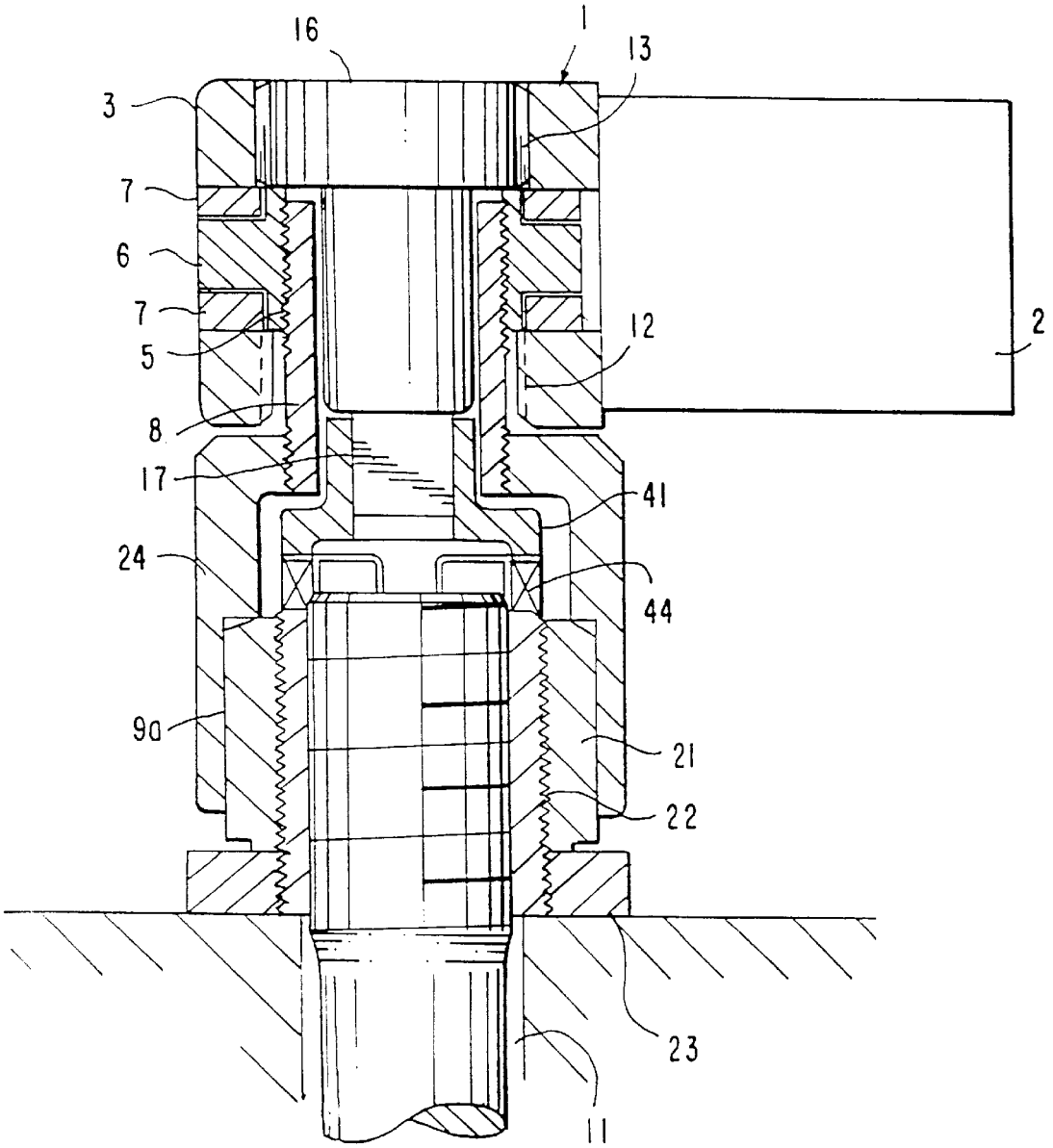
FIG. 4 is a view showing a universal torque power tool in accordance with the present invention which applies an action force to a nut and a reaction force to a stationary object engageable inside said nut engagement.

The universal torque power tool shown in FIG. 4 is also used, as in the embodiment of FIG. 2 for acting on a stud 11 which is provided with a clamp nut including the outer sleeve 21, the inner sleeve 22, and the washer 23. A reaction socket 41 which is non-rotatably connected with the projection 17 of the stepped shaft 16 has a lower end connected to the inner sleeve 22 through interengaging castellations 44. The first transfer means 12 do not transfer any reaction force and therefore are not engaged with any connecting means. During the operation of the tool shown in FIG. 4 an action force applied by the motor means 4 to the outer sleeve 21 via the engagement 9*a*, while the reaction force of the housing is applied through the second transfer means 13, the stepped shaft 16 and the reaction socket 41 to the inner sleeve 22 which forms an object engageable inside the nut engagement 9*a* of the outer sleeve 21 forming the nut. As a result, the outer sleeve 21 is turned, while the inner sleeve 22 is moved only axially along the axis A, and the bolt 11 is being tensioned or pulled straight up.

Figure 5:
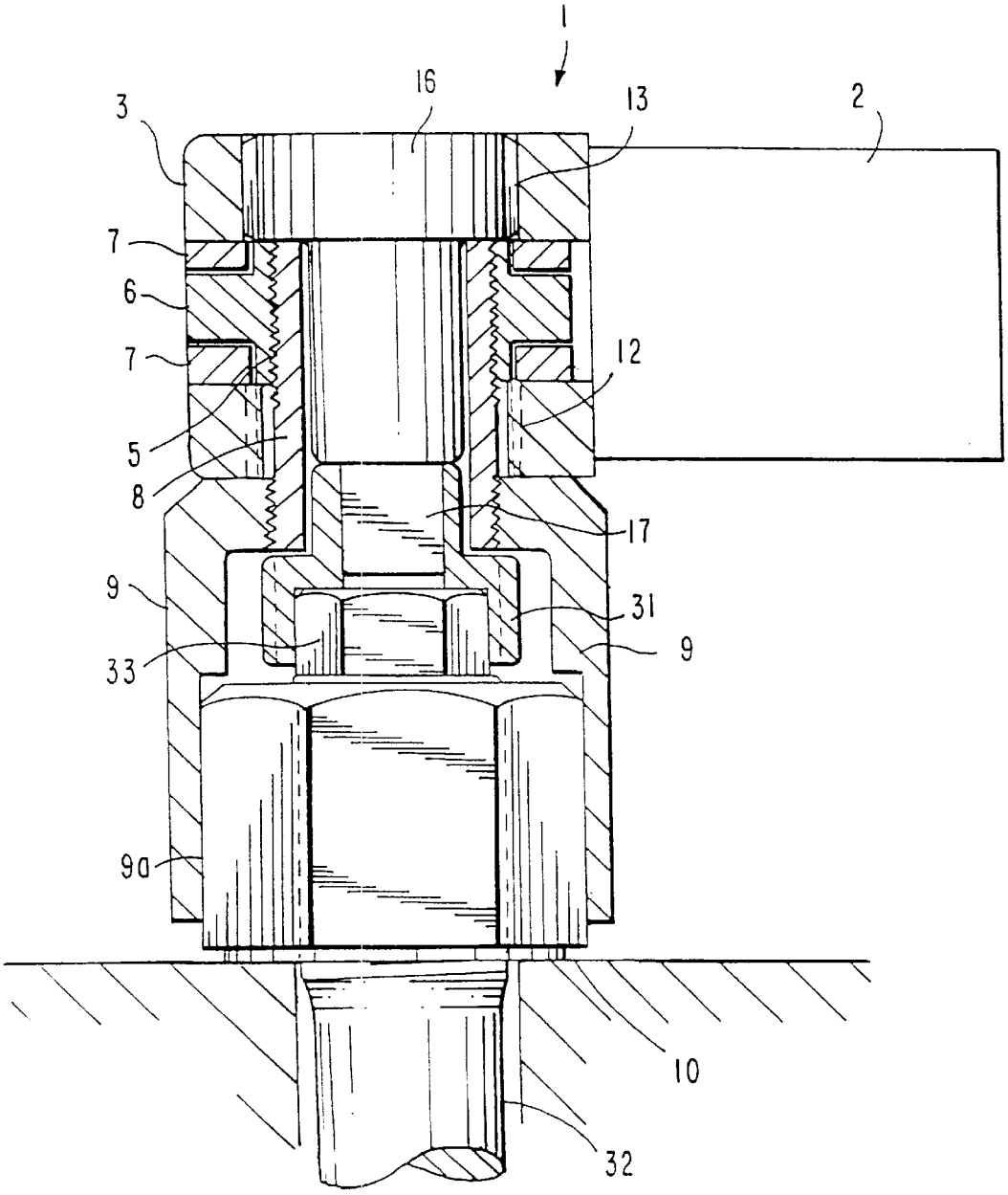
FIG. 5 is a view showing a universal torque power tool in accordance with the present invention which applies reaction force to a different stationary object engageable inside said nut engagement.

In the universal torque power tool shown in FIG. 5, the action force applied by the motor means 4 to the ratchet 6 is transmitted through the drive sleeve 8 and the socket 9 via the nut engagement 9*a* to the nut 10 which is screwed on the bolt 11, the first transfer means 12 is not engaged, while the second transfer means 13 transfer a reaction force from the housing through the stepped shaft 16 and the reaction socket 31 to the bolt head 33 which is a stationary object engageable inside the nut engagement 9*a*. As a result, the nut is being torqued.

It will be understood that each of the elements described above, or two or more together, may also find a useful application in other types of constructions differing from the types described above.

While the invention has been illustrated and described as embodied in universal torque power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A universal torque power tool, comprising a housing having motor means; a driving mechanism being operatively connected with said motor means, said driving mechanism including drive means having an axis and being engageable with a nut to be turned; first and second transfer means to apply reaction force substantially coaxial with said axis of said drive means and being spaced from one another in direction of said axis, said drive means being formed to transfer an action force from said motor means to said nut to be turned, said transfer means being formed to transfer said reaction force from said housing to the stationary object, so that when said stationary object is engaged outside the nut engagement with said drive means said first transfer means transfer the reaction force to the stationary object, and when said stationary object is engaged inside said nut engagement with said drive means said second transfer means transfer the reaction force to the stationary object.

2. A universal torque power tool as defined in claim 1, wherein said transfer means is formed so that when the stationary object comprises a first stationary object engageable outside said nut engagement and a second stationary object engageable inside said nut engagement said first and second transfer means transfer the reaction force to the first and second stationary objects.

3. A universal torque power tools as defined in claim 1, where said drive means further include a turnable driving element which is turned by said motor means around a second axis, said first and second transfer means being located on opposite axial sides of said turnable driving element as considered in direction of said second axis.

4. A universal torque power tools as defined in claim 2, wherein said drive means further include at least one engaging element which is engageable with the nut to be turned and is operatively connected with said driving element so as to be turned by said driving element and thereby to turn the nut.

5. A universal torque power tool as defined in claim 2; and further comprising a plurality of engaging elements each connectable with said driving element and alternatingly engageable with different nuts to be turned.

6. A universal torque power tool as defined in claim 1; and further comprising connecting means operative for connecting said transfer means with the objects and including at least one first connecting element adapted to connect said first transfer means with the object outside said nut engagement, and at least one second connecting element adapted to connect said second transfer means with the object inside said nut engagement.

7. A universal torque power tool as defined in claim 6, wherein at least one of said connecting elements includes a plurality of connecting members formed to connect at least one of said transfer means with different objects.

8. A universal torque power tool as defined in claim 6, wherein each of said connecting elements includes a plurality of connecting members formed to alternatingly engage different objects.

* * * * *